United States Patent [19]

Deforeit

[11] Patent Number: 4,500,317

[45] Date of Patent: Feb. 19, 1985

[54] METHOD OF AND APPARATUS FOR PRODUCING AN ORCHESTRA EFFECT

[75] Inventor: Christian J. Deforeit, Semur-en-Auxois, France

[73] Assignee: Matth. Hohner AG, Trossingen, Fed. Rep. of Germany

[21] Appl. No.: 501,531

[22] Filed: Jun. 6, 1983

[30] Foreign Application Priority Data

Dec. 15, 1982 [DE] Fed. Rep. of Germany ..... 3246418

[51] Int. Cl.[3] ..... G10H 1/043

[52] U.S. Cl. ..... 84/1.24; 84/DIG. 4

[58] Field of Search ..... 84/1.24, 1.25, DIG. 4; 381/62

[56] References Cited

U.S. PATENT DOCUMENTS

| | | | |
|---|---|---|---|
| 3,272,906 | 9/1966 | De Vries et al. | 84/1.25 |
| 3,719,782 | 3/1973 | Barnum | 381/62 |
| 3,842,204 | 10/1974 | Leslie | 381/62 |
| 3,886,835 | 6/1975 | Peterson | 84/1.24 |
| 4,162,372 | 7/1979 | Gross | 381/62 |

*Primary Examiner*—Stanley J. Witkowski

[57] ABSTRACT

An "orchestra effect" is produced in an electronic musical instrument by mixing a signal at the commanded frequency with a second signal which is displaced in frequency from the commanded signal, the second signal also periodically varying in frequency. The difference in frequencies between the commanded signal and the signal which is mixed therewith is preferably less than one-half the total variation in frequency of the latter signal.

2 Claims, 2 Drawing Figures

METHOD OF AND APPARATUS FOR PRODUCING AN ORCHESTRA EFFECT

BACKGROUND OF THE INVENTION (1) Field of the Invention

The present invention relates to the synthesis of sound and particularly to the production of complex tones which simulate the sound produced by multiple instruments simultaneously playing the same note, i.e., "orchestra effect". More specifically, this invention is directed to circuitry for use in electronic musical instruments and especially to circuits for generating a waveform which will cause a transducer to produce an "ensemble" or "orchestra" effect in response to a frequency related command signal. Accordingly, the general objects of the present invention are to provide novel and improved methods and apparatus of such character.

(2) Description of the Prior Art

The sound which results when a plurality of different instruments all produce the same nominal tone is known in the art as "orchestra effect". "Orchestra effect" is also sometimes referred to as "ensemble effect" or "string chorus effect". The latter term results from the fact that in a conventional piano a single key may excite several strings tuned to the same basic frequency. A similar effect will be produced by a human chorus singing the same note, by a brass group playing the same note, etc.

With respect to electronic musical instruments, i.e., electronic organs, implementation of "orchestra effect" permits the actuation of a single key on a single keyboard to result in the generation of a frequency mix which, to the listener, sounds as if a plurality of instruments all producing the same nominal tone had been played. Methods of simulating such an "orchestra effect" in electronic musical instruments are known in the art as exemplified by the disclosure of U.S. Pat. No. 4,354,415. In this patent a basic audio frequency signal is mixed with a plurality of further signals at different frequencies which have been derived from the basic signal and randomly frequency-shifted with respect thereto. The technique of U.S. Pat. No. 4,354,415 contemplates the use of parallel "bucket brigade" circuits which introduce different delays to the frequency related input signals thereto in response to control signals. The control signals for determining the time delays are derived from sub-audio or infra-audio signals which are typically on the order of a few cycles per second. Relatively complex circuitry is required to implement the method of U.S. Pat. No. 4,354,415. Further, bearing in mind that most modern electronic musical instruments are digital devices, the method of U.S. Pat. No. 4,354,415 is very difficult to implement digitally.

U.S. Pat. No. 3,978,755 discloses a digital electronic musical instrument which may be designed such that it permits the generation of an "ensemble effect" or "orchestra effect". In accordance with U.S. Pat. No. 3,978,755 the amplitude data of complex waveforms are stored, the stored information being read out under the control of an address generator. The frequency to be generated is determined by control signals applied to the address generator. These control signals are numerical values. In order to generate the "ensemble effect", the numerical control signal value is modified by a desired magnitude and the modified value is delivered as the control signal to a further address generator, simultaneously with the basic control signal being utilized in the customary manner, which controls the data to be read out of at least one further waveform memory. Implementation of this technique for producing an "orchestra effect" requires complex and expensive circuitry, particularly the use of many oscillators.

SUMMARY OF THE INVENTION

The present invention overcomes the above-briefly described and other deficiencies and disadvantages of the prior art by providing a novel technique for producing an "orchestra effect" which employs the single basic or commanded frequency and a sub-audio or infra-audion modulation frequency. In accordance with this novel technique, the basic frequency is shifted by a few Hertz and the shifted frequency is modulated with the sub-audio frequency. The degree of frequency shift is less than the modulation frequency, i.e., if the modulation frequency is six (6) Hertz, the frequency shift may be four (4) Hertz. The shifted and frequency-modulated signal is subsequently mixed with a signal at the basic frequency and the resultant of this mixing, when applied to a transducer, will generate a sound which truly simulates a chorus or "orchestra effect".

Apparatus for implementing the method of the present invention comprises uncomplicated, and thus inexpensive and reliable, circuitry. In a preferred embodiment this circuitry comprises a first controlled oscillator which receives a command signal commensurate with the tone or frequency to be generated. The preferred embodiment further comprises a second controlled oscillator and means for generating a control signal therefor whereby the second oscillator will provide an output frequency which varies about a median frequency which differs from the output frequency of the first oscillator by, for example only, four (4) Hertz. The means for generating the control signal for the second oscillator, in a first embodiment, comprises means for summing the control signal applied to the first oscillator with a constant and with the output of a sub-audio frequency generator. The constant signal applied to the summing means may result in the control signal for the second oscillator being of a magnitude which will cause the oscillator output to be either greater or less than the basic frequency signal provided by the first oscillator. In one embodiment of the invention, wherein the output frequency of the first oscillator was at a frequency $f_o$, the output of the second oscillator varied between fo plus 10 Hz and fo minus 2 Hz. The outputs of the two controlled oscillators are summed and the resulting complex signal applied to a second transducer.

Apparatus in accordance with the present invention may be implemented employing either digital or analog techniques.

BRIEF DESCRIPTION OF THE DRAWING

The present invention may be better understood and its numerous objects and advantages will become apparent to those skilled in the art by reference to the accompanying drawing wherein.

DESCRIPTION OF THE DISCLOSED EMBODIMENT

Figure 1:
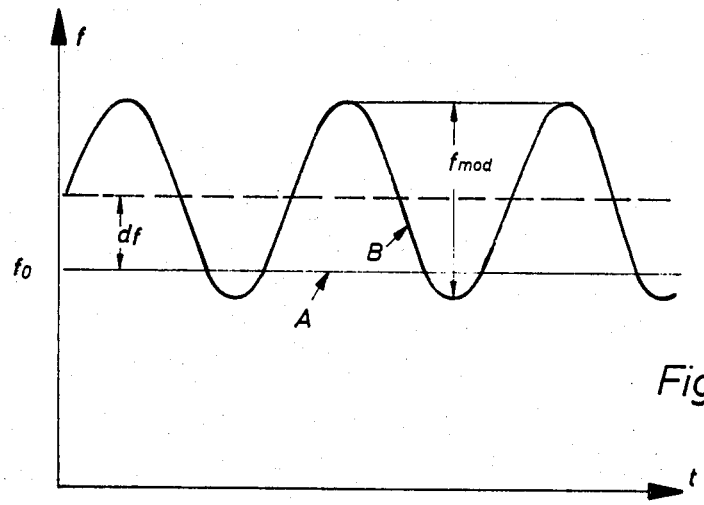
FIG. 1 is a graphical representation which will facilitate understanding of the method of the present invention.

FIG. 1 is a plot of frequency f versus time t. The commanded frequency, i.e., the frequency fo which the player of an electronic organ selects by depression of a key, has been indicated at A. In accordance with the present invention a second signal in the audio frequency range, indicated at B, will be superimposed on signal A. Signal B is frequency-shifted with respect to signal A by a fixed frequency df and is frequency modulated by a sub-audio or infra-audio signal, the magnitude of the difference betwen fo and df being smaller than the magnitude of the variation in frequency fmod. As used herein the term "shifted" is to be understood to be relative to the mean frequency of signal B, i.e., it is the mean frequency of signal B which is shifted with respect to the commanded frequency of signal A. Further, while FIG. 1 indicates that signal B varies in a substantially sinusoidal manner, other waveforms could be employed such as, for example, a triangular waveshape. When the signals A and B are summed, the listener will be unable to distinguish therebetween but will receive the impression of an "orchestra effect".

Figure 2:
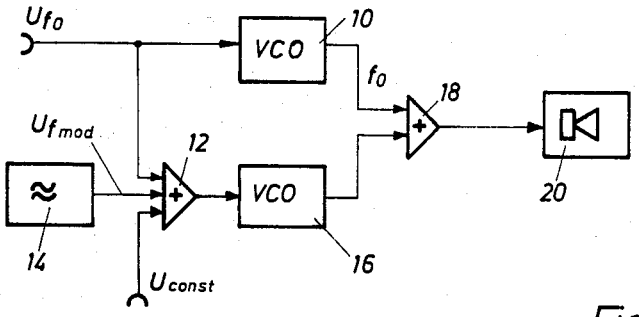
FIG. 2 is a block diagram of a circuit for implementing the present invention.

With reference to FIG. 2, an analog implementation of circuitry for producing the complex waveform A+B of FIG. 1 is shown in block diagram form. It will be understood that the technique represented by FIG. 1 can also be implemented employing digital techniques. The circuit of FIG. 2 employs a first voltage controlled oscillator (VCO) 10 which receives, at its control input, a voltage $U_{fo}$. This control voltage will be selected, for example, by actuation of a key of an organ keyboard. The control voltage $U_{fo}$ has a magnitude such that oscillator 10 will produce an output signal having a frequency fo. The control voltage applied to oscillator 10 is also applied as the first input to a summing circuit 12. The second input to summing circuit 12 is a fluctuating control voltage $U_{fmod}$ generated by a sub-audio frequency generator 14. The third input to summing circuit 12 is a constant voltage $U_{const}$. The magnitude of the constant voltage $U_{const}$ will, at most, be equal to one half of the peak-to-peak amplitude of the output signal provided by frequency generator 14. The constant control voltage $U_{const}$ produces the desired frequency shift df between the outputs of the two voltage controlled oscillators 10 and 16. Thus, the summation of the three input signals to summing circuit 12 produces a control voltage for voltage controlled oscillator 16 whereby oscillator 16 will generate a frequency modulated signal having a mean frequency which is shifted from signal fo by an amount which is equal to, and preferably less than, one half of the total variation in frequency fmod.

The "constant" audio frequency output signal of oscillator 10 is summed with the frequency modulated output signal of oscillator 16 in a further summing circuit 18 and the resultant complex waveform is applied to electro-acoustic convertor means which will typically include a loud speaker 20. The speaker 20 will produce an audible signal which will simulate the effect of an orchestra.

It is to be understood that the invention is not limited to the illustration described and shown herein, which is deemed to be merely illustrative of the best mode of carrying out the invention, and which is susceptible to modification as to form, size, arrangement of parts and details of operation. The invention rather is intended to encompass all such modifications which are within its spirit and scope as defined by the following claims.

What is claimed is:

1. A method for producing a signal which, when applied to a sound transducer, will produce a complex tone commensurate with the effect of different plural sources simultaneously generating the same note, said method comprising the steps of:

producing a first control signal commensurate with a desired frequency;

producing a first audio frequency signal commensurate with said first control signal;

producing a signal which varies at a sub-audio frequency;

producing a second control signal commensurate with a preselected difference between the frequency of said first audio frquency signal and the mean frequency of a second audio frequency signal which varies in frequency;

summing said first control signal, said sub-audio frequency signal and said second control signal to produce a third control signal;

producing said second audio frequency signal in response to said third control signal, said second audio frequency signal varying in frequency over a range which is a function of the peak-to-peak amplitude of the sub-audio frequency signal about a frequency which is commensurate with the algebraic sum of said first and second control signals; and summing said first and second audio frequency signals to produce a complex waveform.

2. Apparatus for producing a signal which, when applied to a sound transducer, will produce an orchestra effect comprising:

first voltage controlled oscillator means for producing a first output signal, said first oscillator means being responsive to a first control signal commensurate with a frequency to be generated by said first oscillator means;

second voltage controlled oscillator means for producing a second output signal;

means for generating a signal which varies periodically at a sub-audio frequency;

means for generating a constant magnitude signal, the amplitude of said constant magnitude signal being less than half the peak-to-peak amplitude of the signal generated by said sub-audio frequency signal generating means;

means for summing said first control signal, said sub-audio frequency signal and said constant magnitude signal to produce an amplitude modulated second control signal, said second control signal containing information commensurate with a mean frequency to be generated by said second oscillator means;

means for delivering said second control signal to said second oscillator means whereby said second oscillator means will produce an output signal having a frequency which varies periodically at said sub-audio frequency, the output frequency of said second oscillator means varying by an amount which is at least equal to the difference between the mean output frequency of said second oscillator means and the frequency of the output signal of said first oscillator means; and means for combining the output signals of said first and second oscillator means.

* * * * *